US005238105A

United States Patent [19]

Smiley

[11] Patent Number: 5,238,105

[45] Date of Patent: Aug. 24, 1993

[54] CONTAINER

[76] Inventor: Howard F. Smiley, 3243 W. Spruce Ave., Fresno, Calif. 93711

[21] Appl. No.: 764,224

[22] Filed: Sep. 23, 1991

[51] Int. Cl.[5] ..... B65D 85/04

[52] U.S. Cl. ..... 206/223; 206/408; 242/77; 242/116; 248/79

[58] Field of Search ..... 206/223, 225, 226, 389, 206/407, 408, 459, 576; 242/77, 77.3, 115, 116; 248/75-79, 89

[56] References Cited

U.S. PATENT DOCUMENTS

| | | | |
|---|---|---|---|
| 766,936 | 8/1904 | Roseau . | |
| 2,580,900 | 1/1952 | Epstein . | |
| 3,047,781 | 10/1968 | Ardire et al. | 206/459 |
| 3,049,227 | 8/1962 | Reinemer | 206/226 |
| 3,587,840 | 6/1971 | Hultberg | 206/408 |
| 3,976,260 | 8/1976 | Irik | 242/77 |
| 4,261,525 | 4/1981 | Wagner . | |
| 4,360,715 | 11/1982 | Jamison et al. . | |
| 4,512,361 | 4/1985 | Tisbo et al. | 248/76 |
| 4,572,370 | 2/1986 | Cedenblad et al. | 206/408 |
| 4,702,373 | 10/1987 | Meade | 206/459 |
| 4,756,488 | 7/1988 | Cooke | 242/116 |
| 4,896,238 | 1/1990 | Oogi et al. . | |
| 4,903,913 | 2/1990 | McCaffrey | 242/115 |
| 4,913,369 | 4/1990 | Lia et al. . | |
| 4,942,964 | 7/1990 | Hsu . | |
| 4,984,685 | 1/1991 | Douglas | 206/408 |

*Primary Examiner*—Jimmy G. Foster
*Attorney, Agent, or Firm*—Worrel & Worrel

[57] ABSTRACT

A container for housing a work object having walls defining a compartment dimensioned to receive a work object; and a mechanism for releasably retaining the work object in the compartment operable to permit a portion of the work object to be dispensed therefrom and thereafter to retain the remainder of the work object in the compartment.

10 Claims, 3 Drawing Sheets

CONTAINER

BACKGROUND OF THE INVENTION

1. Field of the Invention

The present invention relates to a container and, more particularly, to a container which has particular utility in housing discrete, but interoperable, work objects through a series of stages of use.

2. Description of the Prior Art

The packaging of products in dependent upon a host of interrelated and rather complex considerations. For any given product, the only essential requirement for packaging is that some means be provided for individually pricing and transporting each product in the stream of commerce. Depending upon the nature of the product, the products may be handled in bulk, or may require individual packaging in some fashion.

Beyond this essential consideration, are a host of considerations which bear upon the final decision made as to packaging. One such consideration is whether or not the product requires protection or preservation in some form. Another consideration is how far the packaging is to be employed in the stream of commerce to the ultimate consumer. Another consideration is insuring that a multiplicity of such products so packaged can be shipped and stored in bulk. Additional considerations relate to the later stages in the stream of commerce including how the packaged product can be displayed in retail outlets for examination by the potential purchasers. Related to this is the matter of how the purchaser can transport the product to its ultimate destination for use. Still further, in the case of products which may not be fully consumed by the purchaser at one time, there is the matter of whether or not the packaging can be employed to house the remaining product until further consumption is desired. Related to this is the manner in which the packaging may assist in the use of the product by the purchaser. Finally, and in many instances of paramount importance, there is the question of the cost of the packaging. This, of course, bears upon the pricing of the product in the marketplace and upon the profit margin which may be maintained at both the wholesale and retail levels of the marketplace.

The foregoing considerations are rendered considerably more complex where the product to be packaged is composed of a plurality of discrete, but interoperable, elements which are to be sold as a unit and, therefore, must be packaged as a unit. Products of this type are typically those which require some assembly by the ultimate consumer and frequently include a multiplicity of very small and easily lost elements. Packaging for such products most commonly consists simply of a sealed bag or box housing all of the elements in no particular order. Evaluation of packaging of these types against any of the foregoing considerations reveals the disadvantages associated with the use of such packaging.

Furthermore, in the case of such products consisting of a multiplicity of such individual elements, these problems are further compounded where the nature of the product is such that control over one or more of the individual elements during use is required for a satisfactory result to be achieved. For example, products such as irrigation conduit and fittings such are employed in drip irrigation present all of the foregoing problems including the fact that the irrigation tubing must be dispensed is controlled lengths and may well not all be used at any one time. With such products which are not consumed at any one time, there typically is no satisfactory way of continuing to house the remaining, unused elements of the product until use is again required. Prior art packaging for such products typically has involved only sale of the product in bulk, in which case, there is no packaging other than perhaps the sack in which the retail operator deposited the product at the time of sale, or a container such as a sealed plastic bag which is characteristically rendered unsuitable for further use when it is opened. In any case, conventionally there is no satisfactory packaging which can reliably be employed to continue to house the elements composing the product which are not consumed in the first instance of usage.

Therefore, it has long been known that it would be desirable to have a container operable to house a product through the entire stream of commerce from packaging at the time of manufacture through to usage by the ultimate consumer; which can house discrete interoperable elements comprising a single product to be packaged; and which can be employed to assist in usage of those elements of the product through an infinite number of individual instances of usage until the product is entirely consumed.

SUMMARY OF THE INVENTION

Therefore, it is an object of the present invention to provide an improved container.

Another object is to provide such a container which is capable of substantially improved performance over all prior art containers.

Another object is to provide such a container which can be employed through the entire stream of commerce from packaging by the manufacturer, shipment, storage, display at the retail outlet, selection by the ultimate consumer, transport by the consumer to the place of usage, and repeated reusage of the product until the product is entirely consumed.

Another object is to provide such a container which has particular utility in housing discrete and interoperable components comprising a product marketed as a unit maintaining the order thereof and assisting in the usage thereof while minimizing the risk of loss.

Another object is to provide such a container which is remarkably well suited to housing irrigation tubing, such as is employed in drip irrigation, together with a multiplicity of fittings, such as connectors, elbows, tees and tube plugs maintaining these elements in discrete compartments, protecting them through the entire stream of commerce and through usage thereof even over a prolonged period of instances of such use and itself interoperable with the elements to assist in their assembly and use.

Another object is to provide such a container which possesses a unique ability to package the product while being displayed at a retail outlet with the explanatory indicia associated therewith prominently visible for consideration by potential purchasers without in any way harming the integrity of the container or the product and at a minimum cost for such packaging consistent with the operational objectives associated therewith.

Another object is to provide such a container which can be employed to house a flexible elongated and substantially continuous member in coiled relation thereabout operating to maintain the integrity of the coil thereby retaining the member in its stored relation until desired for use, which is operable to pay out the desired length of the flexible member for use and which can immediately be employed in securing the remaining flexible member in the coil configuration without risk of losing control thereof.

Further objects and advantages are to provide improved elements and arrangements thereof in an apparatus for the purpose described which is dependable, economical, durable and fully effective in accomplishing its intended purpose.

These and other objects and advantages are achieved in the container of the preferred embodiment of the present invention having a reel with a pair of circular sidewalls interconnected in substantially parallel relation by a hub extending therebetween concentric to an axis of rotation and, with the sidewalls defining a first compartment extending about the hub adapted to receive the flexible work object wound within the first compartment about the hub, a hole in the hub adapted to receive and thereby retain a first end of the flexible work object, an assembly borne by one of the pair of sidewalls for releasibly retaining a second end of the flexible work object and a passage extending through the hub substantially concentric to the axis of rotation; a compartment assembly mounted in the passage of the hub having a substantially cylindrical wall defining a passage substantially concentric to the axis of rotation and interconnected with the hub by a plurality of supports defining at least one second compartment between the supports, cylindrical wall and hub for the receipt of work objects other than said flexible work object and the second compartment bounded at one end by an end wall and having an open mouth at the other end thereof; a cover plate dimensioned to cover the mouth of the second compartment in capturing relation to the work objects therewithin and a central opening; and a mechanism for releasibly mounting the cover plate on the hub in covering relation to the second compartment with a central opening of the cover plate substantially aligned with the passage of the cylindrical wall substantially concentric to the axis of rotation whereby the flexible work object can be stored in the first compartment and dispensed therefrom by inserting a shaft in the passage of the cylindrical wall and through the central opening of the cover plate to rotate the reel substantially about the axis of rotation paying out a selected length of the flexible work object, severing the length desired from the length paid out to form a new end portion and attaching the new end portion to the assembly releasibly to retain the length of the flexible work object in the first compartment and the other work objects can be removed from the second compartment by removal of the cover plate from the reel in a selected quantity so as to be interoperable with the flexible work object.

DESCRIPTION OF THE PREFERRED EMBODIMENT

Figure 1:
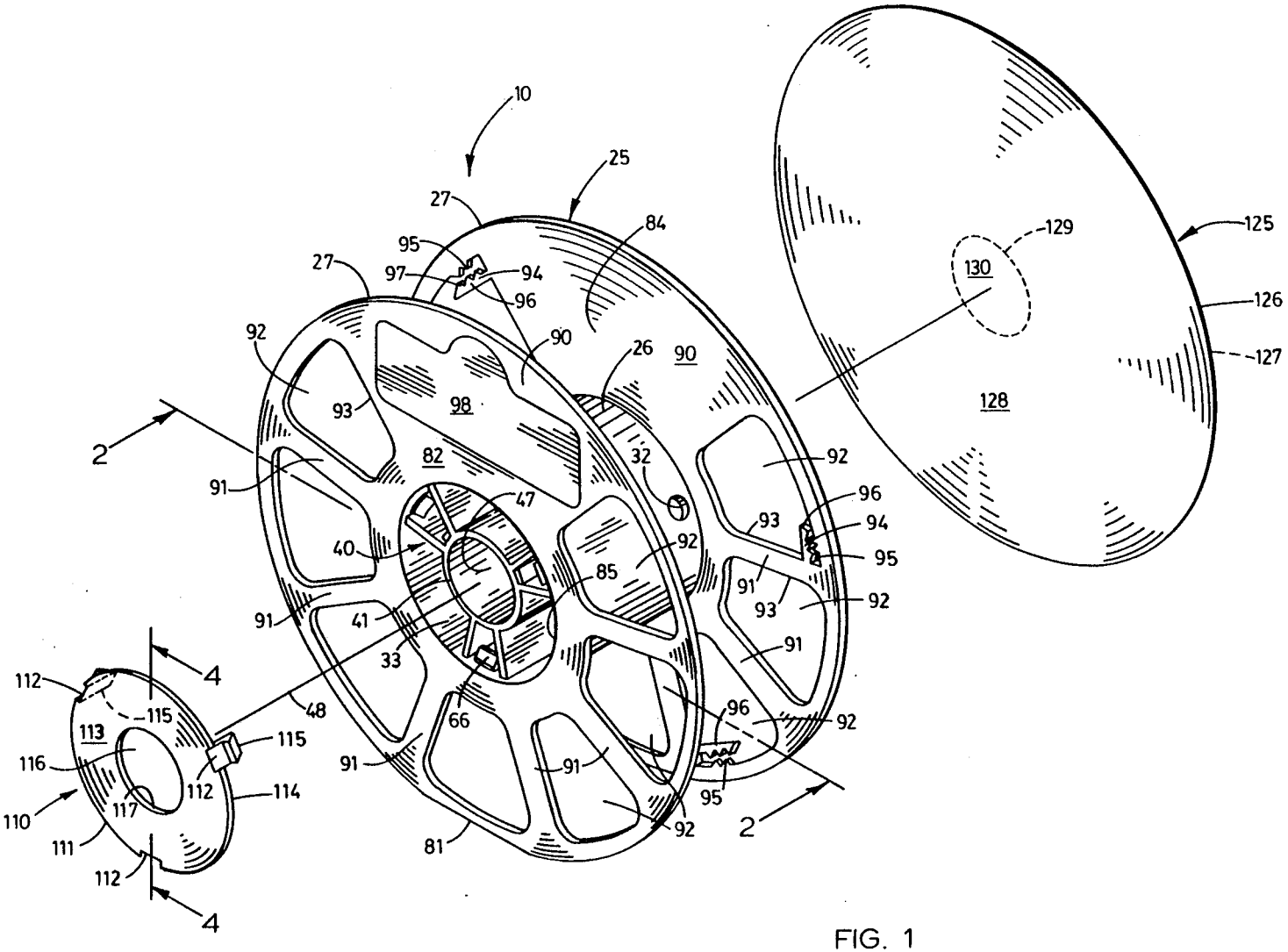
FIG. 1 is an exploded perspective view of the container of the present invention.
Figure 3:
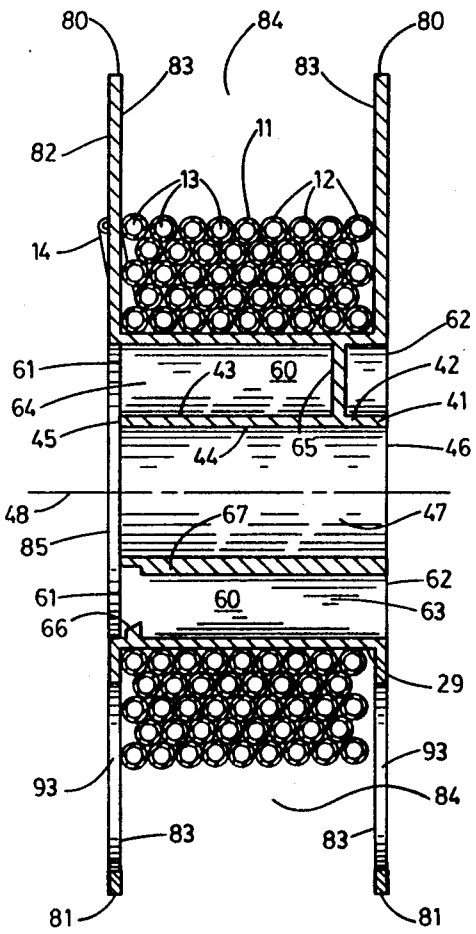
FIG. 3 is a longitudinal, vertical section taken on line 3—3 in FIG. 2.

Referring more particularly to the drawings, the container of the present invention is generally indicated by the numeral 10 in FIG. 1. The container of the present invention can be employed in housing a wide variety of types of products, but has particular utility in housing products such as are used in irrigation. More particularly, the container is uniquely well suited to housing irrigation tubing, such as indicated at 11 in FIG. 3, employed in drip irrigation together with a multiplicity of fittings employed and interoperable with such tubing in an installed configuration. Such fittings are not shown in the drawings but can be, for example, any such small plastic fittings employed with drip irrigation tubing including connectors, elbows, tees, tube plugs and the like. The irrigation tubing is of flexible plastic construction and of relatively small diameter formed by a cylindrical wall 12 enclosing a passage 13 extending the entire length thereof. The tubing has opposite end portions 14 each of which has a mouth 15 interconnecting the passage and the exterior of the tubing.

The container 10 includes a reel 25, perhaps best shown in FIG. 1. The reel is preferably constructed of a substantially rigid, durable and lightweight plastic material. The reel has a substantially cylindrical hub 26 interconnecting a pair of substantially flat, parallel disks or sidewalls 27. The hub has a cylindrical wall 28 having an outer surface 29 and an inner surface 30. The cylindrical wall extends to opposite annular edges 31. A tubing hole 32 extends through the cylindrical wall of the hub adjacent to one of the sidewalls 27. The cylindrical wall encloses an interior 33.

Figure 2:
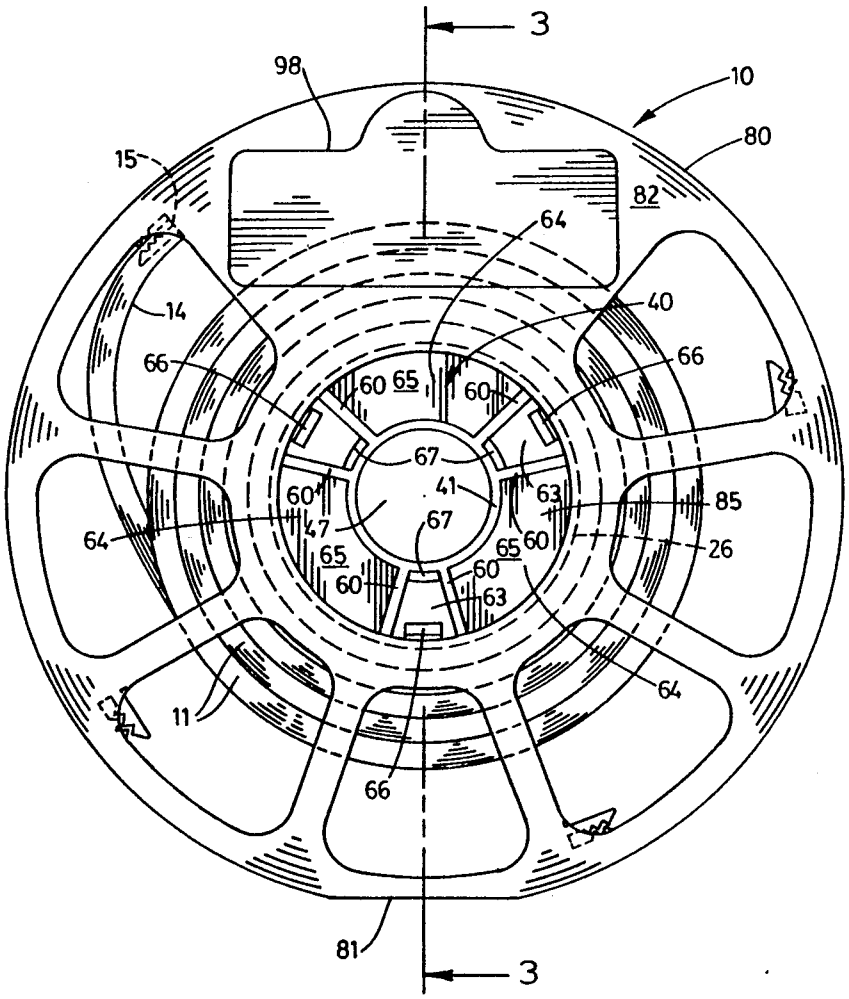
FIG. 2 is a somewhat enlarged, front elevation of the reel of the container of the present invention taken from a position indicated by line 2—2 in FIG. 1.

A central compartment assembly 40 is mounted in the interior 33 of the hub 26 as can perhaps best be visualized in FIGS. 1 and 2. It will be understood that while the reel and all components thereof including the central compartment assembly can be assembled from individual components, in the preferred embodiment the entire reel, including the central compartment assembly, is a single molded product. The central compartment assembly has a central cylinder 41 having an outer surface 43 and an inner surface 44. The central cylinder is substantially concentric to the cylindrical wall 28 of the hub 26. The cylindrical wall has a front annular edge 45 and a rear annular edge 46. The cylindrical wall has an interior 47. The cylindrical wall 28 of the hub and the cylindrical wall 42 of the central cylinder are concentric to an axis of rotation 48 extending therethrough.

The central compartment assembly 40 includes a plurality of vanes or supports 60 which interconnect the outer surface 43 of the cylindrical wall 42 and the inner surface 30 of the cylindrical wall 28. The supports are substantially radially extended therebetween and are grouped in pairs as can be seen in FIGS. 1 and 2. The vanes have front edges 61 and rear edges 62 which are disposed in the same respective planes as the respective front and rear annular edges 45 and 46, respectively, of the cylindrical wall 42 of the central cylinder 41.

The supports 60 constituting each pair define a latch compartment 63 therebetween. The adjacent supports of adjacent pairs of supports bounding individual latch compartments define a storage compartment 64 therebetween. Thus, as can be seen in FIGS. 1 and 2, the supports are grouped so as to define three relatively narrow latch compartments 63 and three relatively broad storage compartments 64. Each of the storage compartments is bounded adjacent to its rear edge 62 by a back wall 65 extending between the adjacent supports in substantially right angular relation thereto. Within each latch compartment 63 is a latch stop 66 mounted on the inner surface 30 of the cylindrical wall 28 of the hub 26 immediately adjacent to the annular edge 31 on the left as viewed in FIG. 3. As can also be seen in FIG. 3, the outer surface 43 of the cylindrical wall 42 within each latch compartment 63 has a thickened portion 67 which results from the molding process employed in forming the reel of the preferred embodiment.

The sidewalls 27 of the reel 25 have substantially circular peripheral edges 80 which are substantially concentric to the axis of rotation 48 and, when considered together, define a cylinder which is concentric to the axis of rotation 48. The peripheral edges 80 have corresponding by positioned flat portions 81 best shown in FIG. 2 for purposes subsequently to be described. Each of the sidewalls 27 has an outer surface 82 and an opposite inner surface 83. The inner surfaces 83 of the sidewalls and the outer surface 29 of the hub define a circular channel 84 extending about the hub. A central opening 85 is provided in each sidewall communicating with the interior 33 of the cylindrical wall 28 of the hub 26.

As can be visualized in FIGS. 1 and 2, each sidewall outwardly of the hub 26 has a continuous upper plate portion 90 and a plurality of radiating spokes 91 spaced to define a plurality of openings 92. Each opening is defined by an edge 93. The sidewall 27 on the right, as viewed in FIGS. 1, 3 and 4, can be considered the rear sidewall. That sidewall mounts a plurality of jaw assemblies 94, in effect forming a part of the edge 93 defining certain of the openings 92. Each jaw assembly is composed of a plurality of outer teeth 95 projecting outwardly from the edge 93 in the direction of the opening 92 and a projection 96 extending in adjacent, but spaced, relation to the outer teeth and mounting a plurality of inner teeth 97 facing and disposed for meshing interrelationship with the outer teeth so as to form the jaw assembly 94. It will be understood that the projection has limited resilient flexibility which allows the teeth to be moved slightly to and from each other. However, when released, the projection and inner teeth return to the spaced juxtaposition relative to the outer teeth heretofore described. The sidewall 27 on the left as viewed in FIGS. 1, 3 and 4 mounts a label 98 on the outer surface 82 of the upper plate portion 90 thereof. The label can bear a variety of indicia including trademarks, patent numbers, parts numbers, the manufacturer's name and address and the like.

Figure 4:
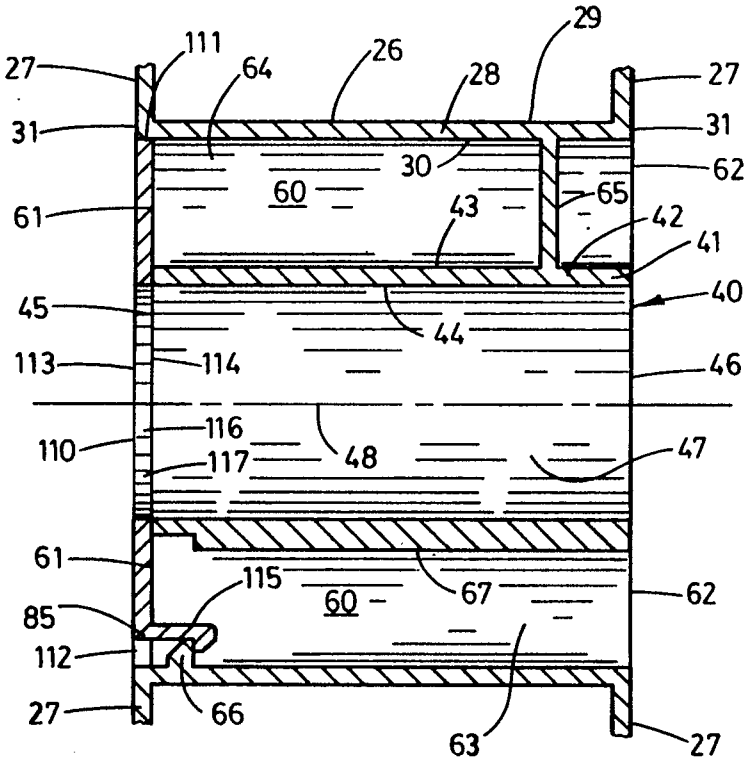
FIG. 4 is a somewhat enlarged, fragmentary, longitudinal, vertical section taken from the same position indicated by line 3—3 in FIG. 2 and showing the cover plate of the container in its attached position.

The container 10 includes a cover plate 110, shown in FIGS. 1 and 4, which in the preferred embodiment of the invention is molded from a suitable substantially rigid plastic material, like the reel 25, and is of single piece construction. The cover plate has a substantially circular peripheral edge 111 having three notches 112 therein. The cover plate has an outer surface 113 and an opposite inner surface 114. The cover plate mounts three latches 115 extending outwardly from the inner surface 114 of the cover plate in substantially right angular relation thereto and individually immediately beneath each notch. The latches are preferably molded as integral parts of the cover plate and are of limited resilient flexibility. The cover plate has a substantially circular peripheral opening 116 defined by a circular edge 117 of the same diameter as the inner surface 44 of the cylindrical wall 42 of the central compartment assembly 40. As may be seen in FIG. 4, the position and relationship of the latches 115 is such as to permit the cover plate to be inserted within the central opening 85 of the sidewall 27 on the left as viewed in FIG. 4 for releasable engagement of the latches 115 with the respective latch stops 66 to retain the cover plate in covering relation to the storage compartments 64, as well as the latch compartments 63. It will be understood that the latches can be released from the latch stops by insertion of a screwdriver blade or the like through one or more of the notches to apply downward pressure against the respective latches to pull them free of the latch stops as necessary to remove the cover plate from the central opening 85.

The container 10 further includes a circular disk 125 which can be constructed of paper, cardboard or any other suitable material, having a substantially circular peripheral edge 126, an outer surface 127 and an opposite adhesive inner surface 128. The diameter of the disk is such that it can be positioned on and adhesively retained by the adhesive inner surface 128 on the outer surface 82 of the sidewall 27 on the right as viewed in FIGS. 1, 3 and 4. The disk has perforations 129 defining a circle having a diameter substantially identical to the diameter of the inner surface 44 of the cylindrical wall 42. The disk has a circular center portion 130 defined by the perforations 129 which can be removed for purposes subsequently to be defined by separating the center portion along the perforations 129 from the disk. The outer surface of the disk contains any suitable written material, but preferably product information and other explanatory material.

OPERATION

The operation of the described embodiment of the subject invention is believed to be clearly apparent and is briefly summarized at this point. In the illustrative embodiment and usage for the container described herein, the manufacturer of the irrigation tubing 11 and the fittings, not shown, therefore are placed in the container at the time of manufacture. In the case of the irrigation tubing 11, this is achieved by insertion of one of the end portions 14 of the irrigation tubing through the tubing hole 32 and then by winding the length of irrigation tubing within the circular channel 84 between the sidewalls 27 so as to coil the irrigation tubing about the hub 26. After completion of this coiling process, the free end portion 14 of the irrigation tubing is secured on one of the available jaw assemblies 94 on the rear sidewall viewed on the right in FIGS. 1, 3 and 4. This is achieved by insertion of the projection 96 into the mouth 15 of the available end portion 14 whereby, upon release, the outer teeth 95 and inner teeth 97 engage the wall 12 releasably to retain the end portion in a secure but available position on the sidewall.

The fittings, not shown, are preferably individually deposited within the storage compartments 64 so that like fittings are stored together. Thus, for example, one storage compartment may contain a plurality of connectors; a second storage compartment, a plurality of elbows; and a third storage compartment a plurality of tube plugs. Alternatively, of course, the fittings can be intermixed and stored in the compartments. The fittings are retained in their respective compartments by securing of the cover plate 110 in covering relation to the storage compartments by individually securing the latches 115 on their respective latch stops 66 within the latch compartments 63. As can be visualized in FIGS. 1 and 4, the securing of the cover plate in the position described seals the storage compartments but leaves a passage of substantially constant diameter extending entirely through the reel concentric to the axis of rotation 48 and comprised of the interior 47 of the cylinder wall 42 and the central opening 116 of the cover plate. If desired, the outer surface 113 of the cover plate can be so molded or can have a suitable label mounted thereon identifying the type of fitting within each storage compartment immediately therebeneath such as, for example, "connectors", "elbows" and "tube plugs".

Similarly, the label 98 and the disk 125 are secured on their respective outer surfaces 82 of the sidewalls 27 at the time of manufacture. As previously noted, the outer surface of the disk 127 preferably bears a variety of printed matter, as may be desired by the manufacture, both to explain and advertise the use and installation of the irrigation tubing 11 and fittings as well as the operation of the container 10 in using the irrigation tubing and fittings. A plurality of the containers can be packed for shipment in larger containers in stacked relation as, for example, rested on the outer surface 82 of either of the sidewalls 27, or as may otherwise be preferred by the manufacturer. If desired, the container can individually be enclosed in a sealed transparent wrapping of any suitable type or otherwise additionally packaged as desired.

The container 10 can be transported entirely through the stream of commerce to the end user in the form described. The rigid reel 25 and cover plate 110 form a protective enclosure for the irrigation tubing 11 and fitting, not shown, and the containers can be stacked in any desired arrangement during such transport, storage and distribution. When displayed at a retail outlet, the container 10 can be disposed in upright relation rested on the flat portions 81 of the peripheral edges 80 of the sidewalls 27 of the reel 25. In this fashion, the container can prominently be displayed in such a position either to display the label 98 or the outer surface 127 of the disk 125 to the potential purchasers. The flat portions 81 of the peripheral edges 80 retain the container in stable upright position and resist rotation of the reel about the axis of rotation 48.

The consumer or purchaser of the container 10 and the products housed therewithin, can transport the products to the area of usage in the container and, similarly, the container bearing the products can be stored by the consumer at any suitable location either rested on one of the sidewalls 27, or in the upright position on the flat portions 81 of the peripheral edges 80 of the sidewalls 27.

When it is desired to use the irrigation tubing 11 and or the fittings, not shown, housed within the container 10, the container is simply carried to the work site in the form heretofore described. If, for example, the irrigation tubing is to be used first, the end portion 14 thereof attached to the jaw assembly 94 is simply pulled free from the jaw assembly as permitted by the outer teeth 95 and inner teeth 97. The reel 25 can be used as a reel by the insertion of a shaft, not shown, through the interior 47 of the cylindrical wall 42 of the central compartment assembly 40 along the axis of rotation 48. The irrigation tubing can then simply be pulled from the reel as the reel rotates under such action about the shaft. When the desired length of irrigation tubing has been paid out, any suitable device is employed to sever the tubing at the point desired thereby creating a new end portion 14 for the tubing. The new end portion can be inserted about the projection 96 so as to be grasped by the outer teeth and inner teeth of the jaw assembly retaining the new end portion in position and the remaining coil of irrigation tubing on the reel.

Where fittings, not shown, are required for use, with or without the irrigation tubing, the reel 25 is preferably disposed in an attitude in which the cover plate 110 faces upwardly. The cover plate is then removed from the reel using a screwdriver, if desired, resiliently to depress the latches 115 away from their respective latch stops 66 thus freeing the cover plate for removal and exposing the storage compartments 64. The user then removes from one or more of the storage compartments the fittings desired and replaces the cover plate so as to continue to retain the fittings, not removed, within their respective storage compartments. The fittings and/or irrigation tubing 11 are then employed in the manner desired to assemble the irrigation system.

If the products within the container 10 are expanded in the first period of usage, the reel 25 and associated parts need no longer be retained. Alternatively, they may be retained for such other usage as the purchaser may have. If some of the fittings and/or irrigation tubing 11 remains for subsequent use, the user can simply store the container 10 with the cover plate 110 in position in either the upright attitude described or rested on one of the sidewalls 27 as also previously described. At any time thereafter if any of the products are required for use, the container 10 can again be taken to the work site for use as previously described.

Therefore, the container of the present invention provides a means by which discrete, but interoperable, work objects, such as irrigation tubing and fittings, can be housed in a single container from the time of manufacture through the entire stream of commerce to the end user and through use and storage thereof by the end user while protecting the work objects from damage and otherwise preserving them for convenient usage all in a container which is inexpensive and otherwise fully effective in accomplishing its operational objectives.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A container for housing discrete interoperable work objects, including a first elongated flexible work object and a second work object, the container comprising a reel having a hub mounting a pair of spaced, substantially parallel walls which, with said hub, define a first compartment dimensioned to receive said first work object in coiled relation about the hub and between the walls and a passage extending through the hub defining an axis of rotation about which the reel can be rotated to dispense the first work object from the first compartment; means mounted on and within said hub defining a second compartment dimensioned to receive the second work object and including a wall extending about said passage and spaced inwardly from the hub to define the second compartment between the wall and the hub; and a closure adapted releasably to be mounted on the hub in covering relation to the second compartment to capture the second work object therewithin.

2. The container of claim 1 wherein said closure has an opening therein whereby, when the closure is releasably mounted in covering relation to the second compartment, the opening communicates with the passage so that a shaft can be extended through said opening and the passage for rotating the reel about the shaft to pay out a selected length of the first work object from the first compartment.

3. A container for housing a length of tubing, the container comprising a reel having a substantially central passage bounded by a substantially cylindrical hub and rotational about an axis of rotation extending substantially axially of said passage and a pair of walls spaced from each other to define with said hub a first compartment; a second compartment between the central passage and the hub for the receipt of a second work object internally thereof accessible through an opening; a closure adapted releasably to be mounted in covering relation to said opening; and means mounted on one of the walls of said pair of walls for grasping the nearest opposite end of the length of tubing to retain the length of tubing wound about the hub in the first compartment whereby the tubing can be reeled from said reel by rotation of the reel about the axis of rotation.

4. The container of claim 3 wherein the walls of said pair of walls are substantially circular and substantially concentric to said axis of rotation and the walls of said pair of walls have corresponding substantially flat edges defining a substantially flat plane substantially parallel to said axis of rotation whereby the container can be rested with the flat edges on a surface of support to resist rotation of the container about said axis of rotation.

5. A container for housing, displaying, transporting and using discrete, but interoperable, work objects including an elongated flexible work object, the container comprising a reel having a pair of substantially circular sidewalls interconnected in substantially parallel relation by a substantially cylindrical hub extending therebetween substantially concentric to an axis of rotation and, with said sidewalls, defining a first compartment extending about the hub adapted to receive said flexible work object wound within said first compartment about the hub, a hole in the hub adapted to receive and thereby retain a first end of said flexible work object, means borne by one of said pair of sidewalls for releasably retaining a second end of said flexible work object and a passage extending through said hub substantially concentric to the axis of rotation; a compartment assembly mounted in said passage of the hub having a substantially cylindrical wall defining a passage substantially concentric to the axis of rotation and interconnected with the hub by a plurality of supports defining at least one second compartment between the supports, cylindrical wall and hub for the receipt of work objects other than said flexible work object and the compartment bounded at one end by an end wall and having an open mouth at the other end thereof; a cover plate dimensioned to cover said mouth of the second compartment in capturing relation to the work objects therewithin and a central opening; and means for releasably mounting the cover plate on the hub in covering relation to the second compartment with the central opening of the cover plate substantially aligned with the passage of the cylindrical wall substantially concentric to said axis of rotation whereby the flexible work object can be stored in said first compartment and dispensed therefrom by inserting a shaft in the passage of the cylindrical wall and through the central opening of the cover plate to rotate the reel substantially about said axis of rotation paying out a selected length of said flexible work object, severing the length desired from the length paid out to form a new end portion and attaching said new end portion to said retaining means releasably to retain the length of the flexible work object in the first compartment and said other work objects can be removed from the second compartment by removal of the cover plate from the reel in a selected quantity so as to be interoperable with said flexible work object.

6. The container of claim 5 wherein said substantially circular sidewalls of the reel have corresponding substantially flat edges substantially defining a plane substantially parallel to the axis of rotation whereby said reel can be rested on said substantially flat edges on a surface of support to resist rotation of the reel about said axis of rotation.

7. The container of claim 6 wherein said retaining means includes a jaw assembly borne by one of said pair of sidewalls between which an end of the flexible work object can be captured releasably to retain said end of the flexible work object and thereby the flexible work object in the first compartment.

8. The container of claim 7 wherein said flexible work object is tubing retained in the first compartment by the first end thereof inserted in the hole of the hub, wound in the compartment about the hub and the second end thereof inserted in said jaw assembly.

9. The container of claim 8 wherein said mounting means of the cover plate include at least two stops mounted on the compartment assembly and at least two latches individually releasably engageable with the stops releasably to retain the cover plate in covering relation to the second compartment.

10. The container of claim 9 including a disk attached on one of said sidewalls on the opposite side thereof from the hub bearing indicia including instructions on the use of the work objects.

* * * * *

UNITED STATES PATENT AND TRADEMARK OFFICE

CERTIFICATE OF CORRECTION

PATENT NO. : 5,238,105

DATED : August 24, 1993

INVENTOR(S) : HOWARD F. SMILEY

It is certified that error appears in the above-identified patent and that said Letters Patent is hereby corrected as shown below:

Column 1, Line 11, delete "in" and substitute ---is---.

Column 8, Line 20, delete "expanded" and substitute ---expended---.

Signed and Sealed this

Twenty-second Day of March, 1994

Bruce Lehman

*Attest:*

BRUCE LEHMAN

*Attesting Officer*

*Commissioner of Patents and Trademarks*